United States Patent [19]

Kurihara et al.

[11] Patent Number: 4,992,124

[45] Date of Patent: Feb. 12, 1991

[54] METHOD OF MAKING CROSS-LAMINATED STRETCHED NON-WOVEN FABRIC

[75] Inventors: Kazuhiko Kurihara; Shigezou Kojima; Hiroshi Yazawa, all of Tokyo; Haruhisa Tani, Tokorozawa; Setsuya Tsuyama, Tokyo; Yasuo Sasaki, Houya, all of Japan

[73] Assignees: Nippon Petrochemicals Co., Ltd.; Polymer Processing Research Institute Ltd., both of Tokyo, Japan

[21] Appl. No.: 302,627

[22] Filed: Feb. 21, 1989

[51] Int. Cl.[5] ..... B29C 47/06

[52] U.S. Cl. ..... 156/161; 156/177; 156/178; 156/180; 156/242; 156/229; 156/244.18; 156/265; 156/244.24; 264/176.1; 264/210.7; 264/210.8; 264/211.14; 264/211.22

[58] Field of Search ..... 156/62.6, 62.8, 163, 156/167, 177, 179, 180, 244.18, 244.24, 229, 264, 265, 245, 242, 178, 181, 161; 264/177.13, 178 F, 176.1, 210.7, 210.8, 211.14, 211.22

[56] References Cited

U.S. PATENT DOCUMENTS

| | | | |
|---|---|---|---|
| 2,574,221 | 11/1951 | Mozligliani | 156/167 |
| 2,982,310 | 5/1961 | West | 156/242 |
| 3,616,037 | 10/1971 | Burger | 156/177 |
| 3,682,734 | 8/1972 | Burger | 156/178 |
| 4,185,981 | 1/1980 | Ohsato | 264/211.14 |

*Primary Examiner*—Caleb Weston

*Attorney, Agent, or Firm*—Bucknam and Archer

[57] ABSTRACT

A non-woven fabric having a strength which is comparable to the strength of woven fabric and a method of making such non-woven fabric are disclosed. The non-woven fabric has a laminated structure composed of a warp web of random-laid non-woven fabric stretched lengthwise and hence having a greater strength in the lengthwise direction than in the transverse direction, and a weft web of random-laid non-woven fabric stretched transversely and hence having a greater strength in the transverse direction than in the lengthwise direction. Filaments constituting each of the warp and weft webs are substantially free from molecular orientation and extendible at least two times the original length before the web is stretched. Upon stretching of the web, the un-oriented filaments are substantially stretched to thereby cause molecular orientation therein.

18 Claims, 4 Drawing Sheets

METHOD OF MAKING CROSS-LAMINATED STRETCHED NON-WOVEN FABRIC

BACKGROUND OF THE INVENTION

1. Field of the Invention

The present invention relates to a cross-laminated non-woven fabric composed of a warp web and a weft web laminated crosswise together and having a strength in both of the lengthwise direction and the transverse direction. It also relates to a method of making such cross-laminated non-woven fabric.

Throughout the specification and claims, the term "warp web" is used to refer to a web formed of fibers arranged to extend substantially in the lengthwise direction of the web and hence having a larger strength in the lengthwise direction than in the transverse direction. Likewise, the term "weft web" is used to refer to a web formed of fibers arranged to extend substantially in the transverse direction of the web and hence having a larger strength in the transverse direction than in the lengthwise direction. Further, the term "cross-laminated non-woven fabric" is used to refer to a non-woven fabric having a laminated structure composed of the aforesaid warp and weft webs united together into layers with fibers in the warp web extending crosswise with fibers in the weft web.

2. Description of the Prior Art

Conventional random-laid non-woven fabrics are excellent in bulkiness and texture but they have only a limited strength which is not comparable to the strength of woven fabrics. The non-woven fabrics also have excellent water permeability and filtering characteristics. With such excellent water permeability and filtering characteristics, the non-woven fabrics have recently found their new application to "geo-textiles" (fiber materials for the civil engineering and construction). Such new application is however substantially limited due to the limited strength of the conventional random-laid non-woven fabrics. With this difficulty in view, the present inventors have proposed various attempts to increase the strength of the conventional non-woven fabrics. According to one such attempt, there is provided a non-woven fabric having a laminated structure composed of a warp web of parallel-laid non-woven fabric and a weft web of parallel-laid non-woven fabric united with the warp web in such a manner that fibers in the warp web extend crosswise with the fibers in the weft web. The thus laminated non-woven fabric has an increased strength but this strength is still lower than the strength which is necessary for application to the geo-textile for the civil engineering and construction.

SUMMARY OF THE INVENTION

With the foregoing difficulties in view, it is accordingly an object of the present invention to provide a cross-laminated non-woven fabric which has a strength comparable to the strength of woven fabric and hence can be used as a geo-textile, i.e. fiber material for the civil engineering and construction.

Another object of the present invention is to provide a method of making such cross-laminated stretched non-woven fabric at an increased rate of production.

According to a first aspect of the present invention, there is provided a cross-laminated non-woven fabric comprising:

(a) a first web of stretched non-woven fabric formed of multiplicity of substantially stretched filaments held together, said stretched filaments being un-oriented filaments before they are stretched, said first web being stretched in the lengthwise direction to cause the individual un-oriented filaments to be substantially stretched, thereby causing a molecular orientation therein; and (b) a second web of stretched non-woven fabric formed of multiplicity of substantially stretched filaments held together, said stretched filaments being un-oriented filaments before they are stretched, said second web being stretched in the lengthwise direction to cause the individual un-oriented filaments to be substantially stretched, thereby causing a molecular orientation therein, said second web being laminated with said first web in such a manner that the respective directions of stretch of said first and second webs are crossed perpendicularly to one another.

According to a second aspect of the present invention, there is provided a cross-laminated non-woven fabric comprising:

(a) a first web of stretched non-woven fabric formed of multiplicity of substantially stretched filaments held together, said stretched filaments being un-oriented filaments before they are stretched, said first web being stretched in the lengthwise direction to cause the individual un-oriented filaments to be substantially stretched, thereby causing a molecular orientation therein; and (b) a second web of stretched non-woven fabric formed of multiplicity of substantially stretched filaments held together, said stretched filaments being un-oriented filaments before they are stretched, said second web being stretched in the transverse direction to cause the individual un-oriented filaments to be substantially stretched, thereby causing a molecular orientation therein, said second web being laminated with said first web in such a manner that the respective directions of stretch of said first and second webs being crossed perpendicularly to one another.

According to a third aspect of the present invention, there is provided a method of making a cross-laminated stretched non-woven fabric comprising the steps of:

(a) forming a first web of random-laid non-woven fabric of substantially un-oriented filaments held together;

(b) stretching the first web in the lengthwise direction to cause the individual un-oriented filaments to be substantially stretched, thereby causing a molecular orientation therein;

(c) forming a second web of random-laid non-woven fabric of substantially un-oriented filaments held together;

(d) stretching the second web in the lengthwise direction to cause the individual un-oriented filaments to be substantially stretched, thereby causing a molecular orientation therein;

(e) transversely severing the second web successively into second web pieces of individual lengths substantially equal to the width of said first web;

(f) laminating said second web pieces with said first web, with adjacent edges of said second web pieces slightly overlapping with each other in such a manner that the direction of stretch of the first web and the direction of stretch of the second web pieces are crossed perpendicularly to one another.

According to a fourth aspect of the present invention, there is provided a method of making a cross-laminated stretched non-woven fabric comprising the steps of:

(a) forming a first web of random-laid non-woven fabric of substantially un-oriented filaments held together;

(b) stretching the first web in the lengthwise direction to cause the individual un-oriented filaments to be substantially stretched, thereby causing a molecular orientation therein;

(c) forming a second web of random-laid non-woven fabric of substantially un-oriented filaments held together;

(d) stretching the second web in the transverse direction to cause the individual un-oriented filaments to be substantially stretched, thereby causing a molecular orientation therein;

(e) laminating the first and second webs in such a manner that the respective directions of stretch of said first and second webs are crossed perpendicularly to one another.

Throughout the specification and claims, the term "un-oriented filaments" is used to refer to those filaments which are not drawn, drafted or stretched, which are free from molecular orientation, or which are extendible more than two times its original length when stretched at a proper stretching temperature.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
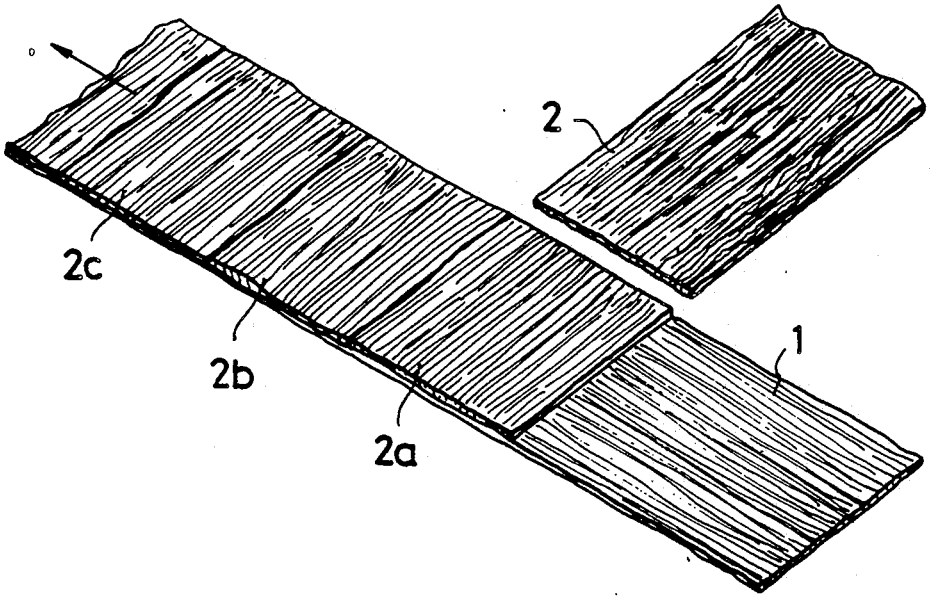
FIG. 1 is a schematic perspective view showing the manner in which a cross-laminated non-woven fabric is produced from two identical continuous longitudinally stretched non-woven fabric webs according to the present invention.

FIG. 1 shows a manner in which a cross-laminated stretched non-woven fabric is continuously produced according to the present invention. The cross-laminated stretched non-woven fabric is composed of a continuous warp web 1 of longitudinally (lengthwise) stretched non-woven fabric formed of generally longitudinally arranged filaments, and a succession of weft webs *2a*, *2b*, *2c* of stretched non-woven fabric united with the warp web 1 with their adjacent edges overlapped with each other. The weft webs *2a–2c* are disposed on the warp web 1 by severing a continuous web 2 of longitudinally stretched non-woven fabric (identical to the warp web 1) successively into individual lengths substantially equal to the width of the warp web 1 as the warp web 2 is fed transversely over the warp web 1 in timed relation to the movement of the warp web 1. Then the warp web 1 and the weft webs 2 disposed thereon are united together by heat-bonding with a cementing medium. The cementing medium is retained in at least one of the warp and weft webs 1, 2 in the form of adhesive filaments produced either concurrently with, or separately from, the extrusion of a main polymer, short staple fibers, an adhesive powder or bubbles. The bonding of the warp and weft webs 1, 2 may be carried out by first dipping the webs 1, 2 into a liquid adhesive such as an emulsion adhesive, then squeezing the webs 1, 2 to remove an excess amount of adhesive, and finally drying the webs 1, 2 either naturally, or forcibly by means of a hot drum, a hot air chamber or an infrared oven. The warp and weft webs 1, 2 may be united together mechanically by punching with barbed needles.

According to the foregoing cross-laminating process, it is possible to produce a cross-laminated stretched non-woven fabric at a rate of 40–50 m/min even when the non-woven fabric has a width greater than 3 m. A further advantage is that the cross-lamination of the warp and weft webs 1, 2 enhances the strength of interengagement between the individual filaments in such a manner as to mend or reform a local separation or breakage of such interengagement which may occur when the webs 1, 2 are longitudinally stretched prior to the bonding. The cross-laminated stretched non-woven fabric thus produced has a large strength in both of the lengthwise direction and the transverse direction. For instance, the tensile strength of the present non-woven fabric is more than three times as large as the tensile strength of a conventional random-laid non-woven fabric which has the same basis weight as the present non-woven fabric. Likewise, the present non-woven fabric have an impact strength, a tear strength, a punching resistance and a seam tear resistance which are about five times as large as those of the conventional random-laid non-woven fabric. Furthermore, the Young's modulus of the present non-woven fabric is more than five times the Young's modulus of the conventional non-woven fabric, and the elongation of the present non-woven fabric is substantially smaller than the elongation of the conventional non-woven fabric. Accordingly, the cross-laminated stretched non-woven fabric of the present invention has an excellent dimensional stability.

Figure 2:
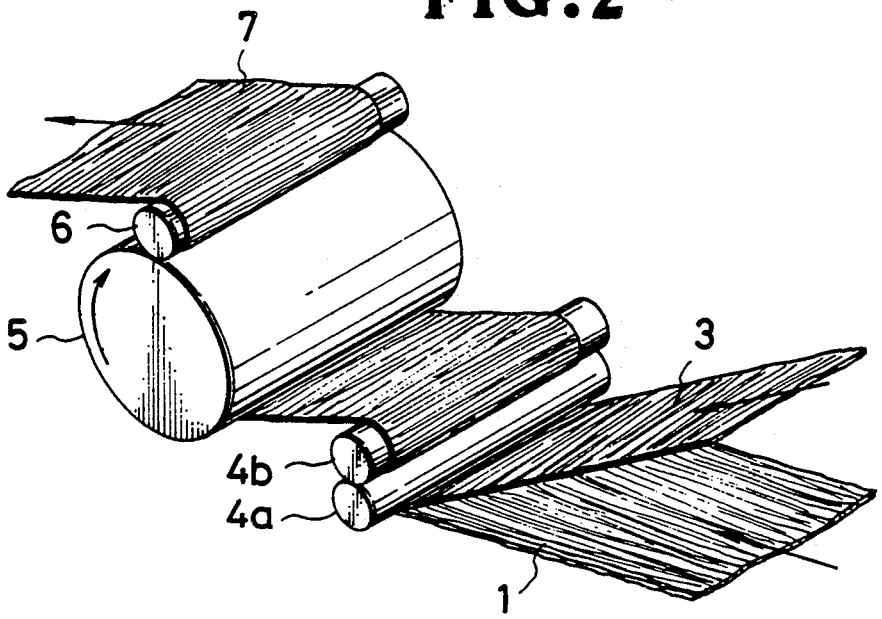
FIG. 2 is a schematic perspective view illustrative of the manner in which a longitudinally stretched non-woven fabric web and a transversely stretched non-woven fabric web are laminated together to form a cross-laminated non-woven fabric according to the present invention.

FIG. 2 shows another laminating process according to the present invention, wherein a continuous warp web 1 of longitudinally or lengthwise stretched non-woven fabric and a continuous weft web 3 of transversely or widthwise stretched non-woven fabric are supplied into a web laminating apparatus in superposed relation to one another. The superposed warp and weft webs 1, 3 are united together as they travel successively around a cooperating pair of nip rolls 4a, 4b, a hot pressure roll 5 and a nip roll 7 which is held against the hot pressure roll 5. The warp and weft webs 1, 3 are united by bonding with a cementing medium in the same manner as done in the embodiment shown in FIG. 1. In case where an emulsion adhesive is used as a cementing medium, the nip roll 4a is partly immersed in a bath of emulsion adhesive for applying the adhesive to the warp and weft webs 1, 3 as they travel around the nip roll 4a. The laminated non-woven fabric 7 has substantially the same strength as the laminated non-woven fabric of the first embodiment shown in FIG. 1. Since the weft web 3, as opposed to the weft webs 2a–2c of the first embodiment shown in FIG. 1, is continuous and devoid of overlapping regions, the non-woven fabric 7 is structurally uniform throughout the entire area thereof.

The filaments constituting the warp webs 1, 2 and the weft webs 2a–2c, 3 are composed of substantially un-oriented filaments before they are stretched. The un-oriented filaments are formed by a melt spinning device shown in FIGS. 3 through 5. The melt spinning device comprises a nozzle plate or spinneret having a central spinning nozzle 8 for extruding a spinning melt of polymeric material in a downward direction to form a filament 9, a plurality (six in the illustrated embodiment) of oblique first air holes 10-1 through 10-6 disposed circumferentially around the spinning nozzle 8 at equal angular intervals for forcing air against the filament 9 while being extruded to thereby cause the filament 9 to move spirally into a downwardly spread conical shape, and a pair of diametrically opposite, horizontal second air holes 11, 11 disposed one on each side of the spinning nozzle 8 and located at a downstream side of the first air holes 10-1 - 10-6 for forcing air in opposite directions parallel to the direction of movement of a screen mesh 12 so as to form two streams of air striking at a position directly below the spinning nozzle 8. The two air streams thus struck causes the spirally moving filament 9 to spread laterally outwardly in a direction perpendicular to the direction of movement of a web of non-woven fabric 13 while being formed on the screen mesh 12.

Figure 3:
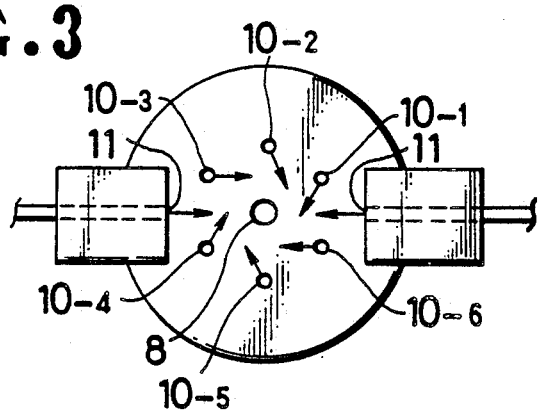
FIG. 3 is a bottom view of a spinning nozzle used for forming filaments arranged or laid transversely of a web.
Figure 4:
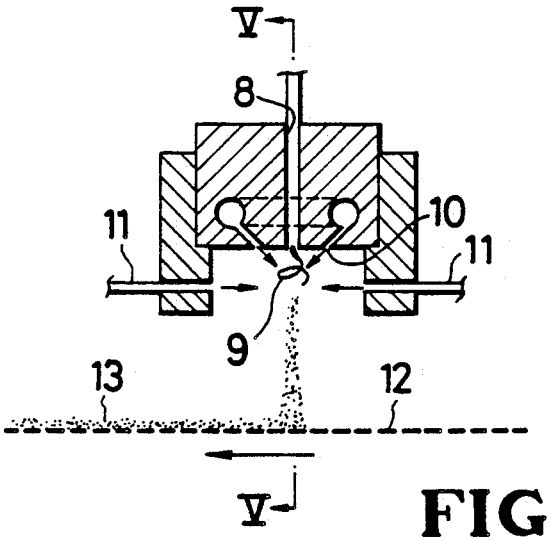
FIG. 4 is a schematic vertical cross-sectional view of an apparatus incorporating the spinning nozzle shown in FIG. 3 for the formation of a non-woven fabric having filaments laid transversely thereof.
Figure 5:
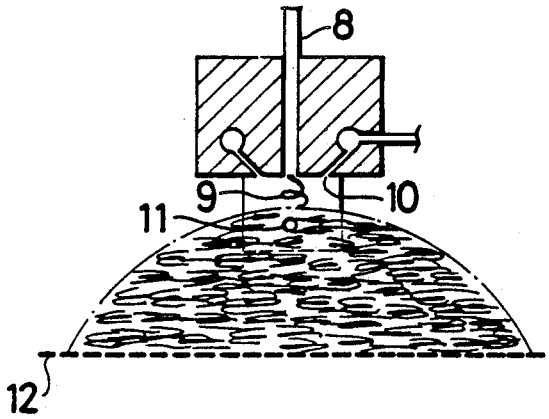
FIG. 5 is a cross-sectional view taken along line V—V of FIG. 4.

The oblique first air holes 10-1 through 10-6 of the spinneret extend tangentially to the spinning nozzle 8 as shown in FIG. 3 and also extend obliquely at an angle with respect to the central axis of the spinning nozzle 8 as shown in FIG. 4. With this arrangement, air blown-off from the respective air holes 10-1 - 10-6 substantially converge at a region spaced downwardly from the spinning nozzle 8 by a distance of from several centimeters to more than ten centimeters. The streams of air thus converged causes the spiral movement of filament 9 stated above. The filament 9 deposited on the screen mesh 12 is mainly laid or arranged transversely of the non-woven fabric 13 while being produced and hence the non-woven fabric 13 is particularly suitable for being stretched transversely thereof. As an alternative, the first air holes 10-1 through 10-6 may be arranged linearly in the vicinity of the spinning nozzle 8 on condition that air blown-off from the air holes 10-1 through 10-6 strikes the filament 9 to thereby cause the same to be spread to some extent before the filament 9 is widely spreaded by the air blown-off from the second air holes 11. The non-woven fabric 13 produced by the melt spinning apparatus with a single spinneret has a width of about 100–300 mm. A non-woven fabric having a width more than 300 mm can be produced by a melt spinning apparatus having a plurality of transversely arranged spinnerets. Furthermore, it is possible to produce a dense non-woven fabric at a high speed by utilizing a melt spinning apparatus in which a plurality of spinnerets are arranged lengthwise of the non-woven fabric.

The air blown-off from the first air holes 10-1 through 10-6 and the air blown-off from the second air holes 11 are heated at a temperature higher than the melting temperature of a polymeric material used for the formation of the filament 9. Heating of either one of the air supplied from the first air holes 10-1 through 10-6 and the air supplied from the second air holes 11 may be omitted depending on the kind of the polymeric material used. With the use of the hot air, the filament 9 while being formed does not undergo substantial molecular orientation.

The spinneret described above can be used for the formation of a non-woven fabric composed of un-oriented filaments laid or arranged substantially in the lengthwise direction of the fabric. In this instance, the spinneret is turned about the central axis of the spinning nozzle 8 through an angle of 90 degrees from the position shown in FIG. 3 to a position in which the second air holes 11 extend perpendicular to the direction of movement of the non-woven fabric while being produced. The thus formed non-woven fabric is particularly suitable for the longitudinal stretching process.

Eligible materials for the filaments of the present non-woven fabric include polyolefine such as high density polyethylene (HDPE) or polypropylene (PP), polyester, polyamide, polyvinylchloride, polyacrylonitrile, polyvinylalcohol, polyurethane, and other polyers which are stretchable and make an increase in strength when they are stretched.

According to an important feature of the present invention, the starting material used for the formation of a non-woven fabric comprises substantially un-oriented filaments. The un-oriented filaments have the following characteristics:

(a) low yield strength: they can be elongated by a small force;

(b) large elongation (more than several times the original length) at a proper stretching temperature; and (c) high strength at room temperature after stretched at the proper stretching temperature.

It has experimentally proved that a non-woven fabric formed of the un-oriented filaments have been stretchable by a tension which is lower than or substantially equal to the strength of interengagement between the individual filaments. In this instance, the individual filaments are stretched to an extent that they are caused to be rearranged to lay in a direction substantially parallel to the direction of stretch. With this stretching of the individual filaments, the ratio of longitudinal (lengthwise) strength to transverse (widthwise) strength is changed from about 7:3 to a range of from about 5:1 to about 10:1.

In the strict meaning, the un-oriented filaments may not be completely free from molecular orientation. Rather, the un-oriented filaments include those filaments which can be elongated several times (preferably more than two times) the original length. Such highly extendible filaments can be manufactured by the melt spinning which is described above with reference to FIGS. 3 through 5.

As opposed to the non-woven fabric formed by the present invention, the conventional random-laid non-woven fabrics are mere planar assemblies of filaments held together either by mechanical interlocking, or by bonding with a cementing medium. Since the strength of interengagement between the filaments is smaller than the strength of the individual filaments, mere stretching of such non-woven fabric automatically results in a breakage of interengagement between the filaments before a substantial stretching or rearrangement of the filaments takes place. Furthermore, the conventional stretching processes give no consideration on various irregularities which are present in the thickness of the non-woven fabric, in the degree of interengagement between the filaments, and in the bondage of the filaments of the non-woven fabric. The non-woven fabric having such irregularities is likely to be ruptured when subjected to stretching forces due to stress concentration in structurally weak areas or portions of the non-woven fabric. Thus, a high magnification of stretch of the non-woven fabric cannot be obtained by the conventional stretching processes.

Furthermore, the conventional non-woven fabrics include short staple fibers or filaments. In a random-laid non-woven fabric made either by a dry process or a wet process, short staple fibers are firmly held together either by mechanical interlocking, or by bonding with a cementing medium. Due to the firm engagement of the short staple fibers, a stretching of the non-woven fabric is practically impossible. Even when the non-woven fabric is stretched, the stretching force is distributed unevenly over the whole individual short staple fibers. On the other hand, a non-woven fabric composed of filaments is hardly stretchable when the filaments used contain bubbles or a large amount of foreign matter. The conventional filaments are drafted to gain strength before they are processed into a non-woven fabric, for example when the filaments are being spun. The strength of the filaments is therefore greater than the strength of interengagement between individual filaments, so that the stretching of the non-woven fabric results in a breakage of such interengagement and the stretching or rearrangement of the individual filaments does not take place.

Figure 6:
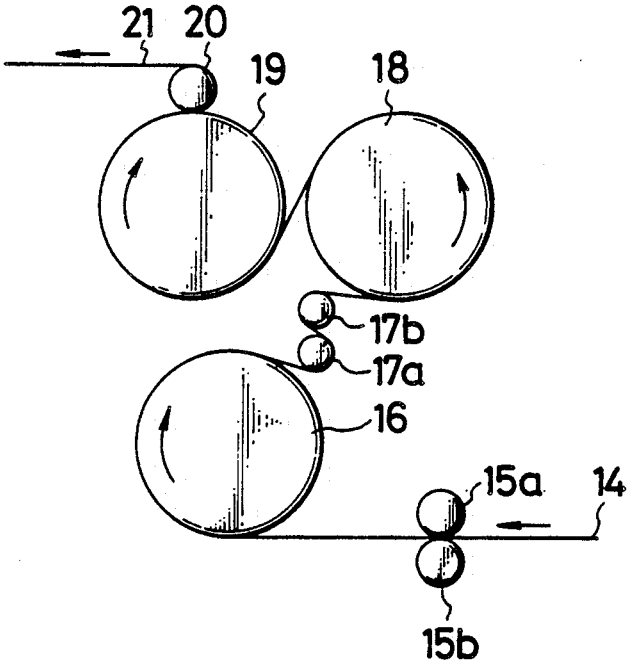
FIG. 6 is a diagrammatical view showing the general construction of a proximity longitudinal stretching apparatus.
Figure 7:
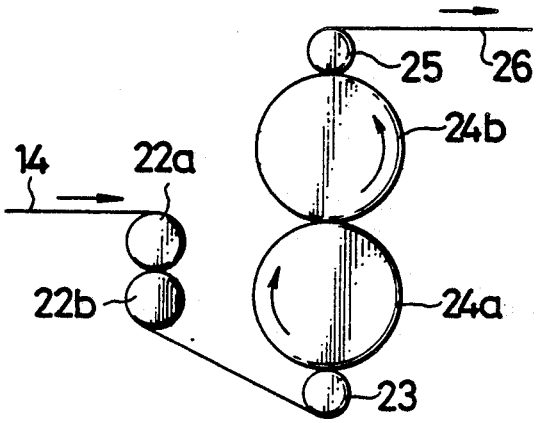
FIG. 7 is a diagrammatical view showing the general construction of a rolling apparatus for rolling a non-woven fabric to stretch the same.

The non-woven fabric formed of un-oriented filaments 9 substantially laid longitudinally or lengthwise of the non-woven fabric is stretched longitudinally either by an apparatus shown FIG. 6, or by an apparatus shown in FIG. 7.

In the apparatus shown in FIG. 6, the non-woven fabric 14 is fed through a cooperating pair of nip rolls 15*a*, 15*b* and then travels around a hot cylinder 16 during which time the non-woven fabric 14 is preheated. Then the preheated non-woven fabric 14 is travels successively around a pair of slightly spaced stretching rolls 17*a*, 17*b* in which instance it is longitudinally stretched as the stretching roll 17*b* is rotating at a speed higher than the speed of rotation of the stretching roll 17*a*. With this lengthwise stretching of the non-woven fabric 14, the individual filaments are substantially stretched to thereby cause molecular orientation therein. The thus longitudinally stretched non-woven fabric 14 is heat-set as it is guided around a heat-treatment roll 18. The heat-set stretched non-woven fabric 14 is cooled to set by a cooling roll 19 and then withdrawn from a nip roll 20. The stretched non-woven fabric 14 thus withdrawn constitutes a continuous warp web 21 of lengthwise stretched non-woven fabric which is thereafter used as a warp web 1, 2 in the production of a laminated stretched non-woven fabric such as described above with reference to FIGS. 1 and 2. In order to obtain a uniformly stretched non-woven fabric, the stretching zone between the stretching rolls 17*a*, 17*b* is limited to a minimum. As a consequence, the stretching rolls 17*a*, 17*b* have a small diameter and they are disposed closely to one another. Preferably, the stretching zone is not more than one-tenths of the original width of the web 14.

In the apparatus shown in FIG. 7, the non-woven fabric 14 formed of un-oriented filaments substantially laid in the lengthwise direction of the non-woven fabric 14 is fed to travel successively around a cooperating pair of nip rolls 22*a*, 22*b*, a turn roll 23, a cooperating pair of pressure rolls 24*a*, 24*b* and a nip roll 25. The pressure rolls 24*a*, 24*b* are heated at a proper stretching temperature and define therebetween a roll nip which is smaller than the starting or original thickness of the non-woven fabric 14. Since the pressure roll 24*b* is rotating faster than the pressure roll 24*a*, the non-woven fabric 14 is stretched lengthwise as it is squeezed between the pressure rolls 24*a*, 24*b*. With this lengthwise stretching of the non-woven fabric 14, the individual filaments are substantially stretched in such a manner as to cause molecular orientation therein. The thus lengthwise stretched non-woven fabric 14 is heat-set as it is guided around the hot pressure roll 24*b*. The heat-set stretched non-woven fabric 14 is then withdrawn from the nip roll 25. The non-woven fabric 14 thus withdrawn from the apparatus constitutes a continuous warp web 26 of lengthwise stretched non-woven fabric which is thereafter used as a warp web 1, 2 of a laminated stretched non-woven fabric such as described above with reference to FIGS. 1 and 2. This stretching (rolling) process is particularly advantageous in that the non-woven fabric can be stretched at a high magnification of stretch even when the non-woven fabric is irregular in thickness or in the degree of interengagement of individual filaments. Another advantage is that the stretched warp web has pearl-like glossy surfaces.

Figure 8:
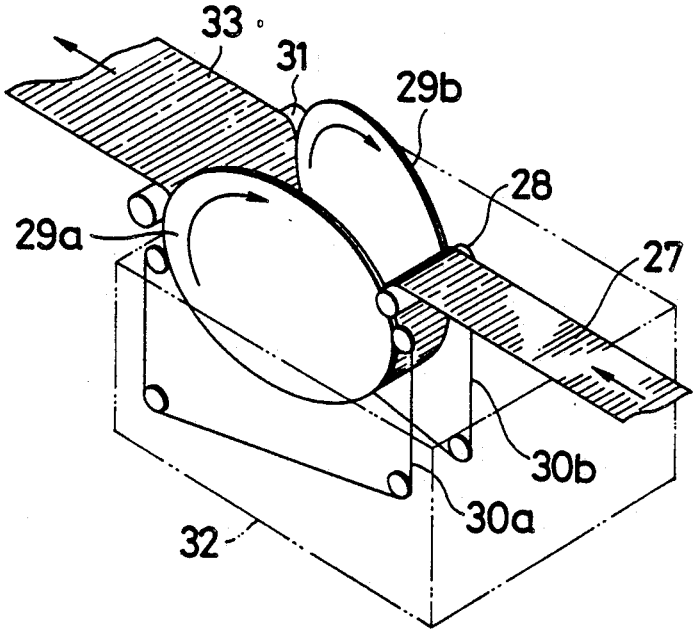
FIG. 8 is a schematic perspective view of an apparatus including pulleys for transversely stretching a non-woven fabric.
Figure 9:
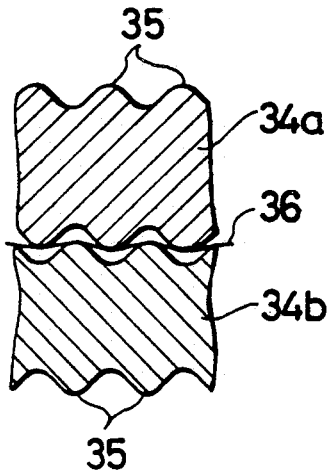
FIG. 9 is a fragmentary cross-sectional view of an apparatus including a cooperating pair of grooved rolls for transversely stretching a non-woven fabric.

The non-woven fabric formed of un-oriented filaments 9 substantially laid transversely of the non-woven fabric is stretched transversely either by an apparatus shown FIG. 8, or by an apparatus shown in FIG. 9.

The apparatus shown in FIG. 8 comprises a pair of laterally spaced pulleys 29*a*, 29*b* rotating at the same peripheral speed and disposed in symmetry with respect to the direction of movement of the non-woven fabric 27 so as to define two divergent arcuate paths on and along their outer peripheral edges, and a pair of endless belts 30*a*, 30*b* trained under tension around respective lower parts of the peripheral edges of the pulleys 29*a*, 29*b* which define the two divergent arcuate paths. The lower parts of the pulleys 29*a*, 29*b* are received in a heating chamber 32 for heating the non-woven fabric 27 as it travel around the pulleys 29*a*, 29*b*. In operation, the non-woven fabric 27 fed longitudinally through a turn roll 28 into the pulleys 29*a*, 29*b* is gripped at its opposite sides or selvages by and between the pulleys 29*a*, 29*b* and the corresponding endless belts 30*a*, 30*b* and then is stretched transversely as the gripped selvages are moved along the two divergent arcuate paths. With this stretching of the non-woven fabric 27, the individual un-oriented filaments are substantially stretched in the transverse direction in such a manner as to cause molecular orientation therein. During stretching, the non-woven fabric 27 is heated by hot water, hot air or an infrared heater which is provided in the heating chamber 32. In case where the hot air is employed, it is preferable to force the hot air to penetrate the non-woven fabric 27, thus providing an increased heat efficiency. The transversely stretched non-woven fabric is withdrawn from a turn roll 31 and constitutes a weft web 33 of transversely stretched non-woven fabric which is thereafter used as a weft web 3 in the production of a laminated stretched non-woven fabric described hereinabove with reference to FIG. 2.

The apparatus shown in FIG. 9 includes a cooperating pair of grooved rolls 34*a*, 34*b*, each roll 34*a* or 34*b* having a plurality of parallel spaced peripheral teeth 35 held in mesh with the teeth 35 of the opposite grooved roll 34*b* or 34*a* for stretching the non-woven fabric 36 transversely as the latter is squeezed between the rolls 34*a*, 34*b*. The transversely stretched non-woven fabric 36 is tentered and thereafter passed through at least one pair of similar grooved rolls (not shown). With this multistage transverse stretching, the resulted non-woven fabric has a high magnification of stretch and is uniform in structure. With the use of the grooved rolls 34*a*, 34*b*, actual stretching takes place at each of transversely juxtaposed narrow areas extending between adjacent teeth 35 on each roll 34*a*, 34*b*. This subdivided stretching is capable of take up or cancel out the irregularities in thickness of the non-woven fabric and the irregularities in bondage or interengagement of the individual filaments. Though not shown, opposite end portions of the respective grooved rolls 34*a*, 34*b* are free from groove so as to firmly grip selvages of the non-woven fabric while being stretched. Alternatively, the selvages of the non-woven fabric 36 may be gripped by and between the grooved rolls 34*a*, 34*b* and a pair of endless belts trained around the opposite ends of one grooved roll 34*a*, 34*b*.

Obviously, various modifications and variations of the present invention are possible in the light of the above teaching. It is therefore to be understood that within the scope of the appended claims the invention may be practiced otherwise than as specifically described.

What is claimed is:

1. A method of making a cross-laminated stretched non-woven fabric comprising the steps of:

(a) forming a first web of random-laid non-woven fabric of substantially un-oriented filaments of a thermoplastic resin held together;

(b) stretching the first web in the lengthwise direction to cause the individual un-oriented filaments to be substantially stretched, at least twice the original length thereof, thereby causing a molecular orientation therein;

(c) forming a second web of random-laid non-woven fabric of substantially un-oriented filaments of a thermoplastic resin held together;

(d) stretching the second web in the lengthwise direction to cause the individual un-oriented filaments to be substantially stretched, at least twice the original length thereof, thereby causing a molecular orientation therein;

(e) transversely severing the second web successively into second web pieces of individual lengths substantially equal to the width of said first web;

(f) laminating said second web pieces with said first web, with adjacent edges of said second web pieces slightly side by side arrangement with each other in such a manner that the direction of stretch of the first web and the direction of stretch of the second web pieces are crossed perpendicularly to one another.

2. A method according to claim 1, wherein each of said first and second webs has a lengthwise tensile strength which is more than five times as large as the widthwise tensile strength of the web.

3. A method according to claim 1, wherein each of said first and second webs is stretched lengthwise at a stretching zone to more than two times the original length while it is heated at a proper stretching temperature, said stretching zone being not more than one-tenths of the original width of the web.

4. A method according to claim 1, wherein each of said first and second webs is stretched by rolling with a cooperating pair of pressure rolls having a roll nip smaller than the original thickness of the web.

5. A method according to claim 1, wherein said un-oriented filaments have an elongation greater than 100 per cent at a proper stretching temperature.

6. A method according to claim 1, wherein said un-oriented filaments are formed by melt spinning of polymeric material and, while being spun, the un-oriented filaments are scattered by streams of hot air heated at a temperature above the melting temperature of said polymeric material.

7. A method according to claim 6, said un-oriented filaments extruded from a spinning nozzle are first urged to move spirally into a downwardly spread conical shape by streams of hot air forced to impinge tangentially against the filaments, and thereafter urged to spread substantially in the lengthwise direction of non-woven fabric while being produced by forcing two opposed stream of air to flow transversely of the non-woven fabric and strike at a position beneath the spinning nozzle.

8. A method of making a cross-laminated stretched non-woven fabric comprising the steps of:

(a) forming a first web of random-laid non-woven fabric of substantially un-oriented filaments of a thermoplastic resin held together;

(b) stretching the first web in the lengthwise direction to cause the individual un-oriented filaments to be substantially stretched, at least twice the original length thereof, (c) forming a second web of random-laid non-woven fabric of substantially un-oriented filaments of a thermoplastic resin held together;

(d) stretching the second web in the lengthwise direction to cause the individual un-oriented filaments to be substantially stretched, at least twice the original length thereof, thereby causing a molecular orientation therein;

(e) laminating the first and second webs in such a manner that the respective directions of stretch of said first and second webs are crossed perpendicularly to one another.

9. A method according to claim 8, wherein said first web has a lengthwise tensile strength which is more than five times as large as the widthwise tensile strength of the web.

10. A method according to claim 8, wherein said first web is stretched lengthwise at a stretching zone to more than two times the original length while it is heated at a proper stretching temperature, said stretching zone being not more than one-tenths of the original width of the web.

11. A method according to claim 8, wherein said first web is stretched by rolling with a cooperating pair of pressure rolls having a roll nip smaller than the original thickness of the web.

12. A method according to claim 8, wherein said un-oriented filaments have an elongation greater than 100 per cent at a proper stretching temperature.

13. A method according to claim 8, wherein said un-oriented filaments are formed by melt spinning of polymeric material and, while being spun, the un-oriented filaments are scattered by streams of hot air heated at a temperature above the melting temperature of said polymeric material.

14. A method according to claim 8, said un-oriented filaments extruded from a spinning nozzle are first urged to move spirally into a downwardly spread conical shape by streams of hot air forced to impinge tangentially against the filaments, and thereafter urged to spread substantially in the transverse direction of non-woven fabric while being produced by forcing two opposed stream of air to flow lengthwise of the non-woven fabric and strike at a position beneath the spinning nozzle.

15. A method according to claim 8, wherein said second web is stretched by gripping opposite selvages of the second web by and between a pair of pulleys rotating at the same peripheral speed and defining two divergent arcuate paths on and along their peripheral edges, and a pair of endless belts trained under tension around the respective pulleys and extending respectively along said divergent arcuate path, and thereafter moving the thus gripped selvages along said divergent arcuate path.

16. A method according to claim 15, wherein said divergent arcuate paths are disposed in a heating chamber.

17. A method according to claim 8, wherein said second web is stretched by being passed through at least one cooperating pair of grooved stretching rolls, each roll having a plurality of parallel spaced teeth held in meshing engagement with the teeth on an opposite grooved roll.

18. A method according to claim 17, wherein said second web is stretched by being passed successively through a plurality of said pair of grooved stretching rolls.

* * * * *

UNITED STATES PATENT AND TRADEMARK OFFICE

CERTIFICATE OF CORRECTION

PATENT NO. : 4,992,124

DATED : February 12, 1991

INVENTOR(S) : Kazuhiko Kurihara, et al

It is certified that error appears in the above-indentified patent and that said Letters Patent is hereby corrected as shown below:

Column 10, line 50 should read

--stretching the second web in the transverse direc- --.

Signed and Sealed this

Twenty-ninth Day of June, 1993

*Attest:*

Michael K. Kirk

MICHAEL K. KIRK

*Attesting Officer*

*Acting Commissioner of Patents and Trademarks*